United States Patent [19]

Kumada et al.

[11] 4,382,206

[45] May 3, 1983

[54] DIRECTLY HEATED TYPE OXIDE CATHODE

[75] Inventors: Masaharu Kumada; Akira Misumi, both of Mobara, Japan

[73] Assignee: Hitachi, Ltd., Tokyo, Japan

[21] Appl. No.: 186,730

[22] Filed: Sep. 12, 1980

[30] Foreign Application Priority Data

Sep. 12, 1979 [JP] Japan ..... 54/116069

[51] Int. Cl.[3] ..... H01J 1/14

[52] U.S. Cl. ..... 313/346 R; 313/346 DC; 313/355

[58] Field of Search ..... 313/346 R, 346 DC, 355

[56] References Cited

U.S. PATENT DOCUMENTS

| | | | |
|---|---|---|---|
| 2,843,517 | 7/1958 | Kerstetter | 313/346 R |
| 2,996,795 | 8/1961 | Stout | 313/346 R |
| 4,081,713 | 3/1978 | Misumi | 313/346 R |
| 4,129,801 | 12/1978 | Soeno et al. | 313/346 R |
| 4,313,854 | 2/1982 | Sunhara et al. | 313/346 R |

*Primary Examiner*—Harold A. Dixon

*Attorney, Agent, or Firm*—Antonelli, Terry & Wands

[57] ABSTRACT

A directly heated type oxide cathode comprising a base made of an alloy containing Ni as a major component and Zr as a reducing agent, a diffusion prevention layer made of Co formed on the base, a coating of Ni powders formed on the diffusion prevention layer, and an electron emissive alkaline earth oxide layer formed on the coating of Ni powders, does not show deformation of Ni powders or peeling of the oxide layer during the production procedures or operation of the cathode.

12 Claims, 3 Drawing Figures

DIRECTLY HEATED TYPE OXIDE CATHODE

BACKGROUND OF THE INVENTION

This invention relates to a directly heated type oxide cathode.

As cathodes used in television display tubes and the like, there are an indirectly heated type oxide cathode and a directly heated type oxide cathode. Since the directly heated type oxide cathode requires about 1 to 2 seconds from the beginning of passing the current to the appearance of images and is superior to the indirectly heated type oxide cathode (about 20 seconds) from the viewpoint of saving energy, it is widely used now.

The directly heated type oxide cathode in principle has a structure as shown in FIG. 1, wherein numeral 1 is a base made of an alloy containing Ni as a major component, numeral 2 is a terminal and numeral 3 is an electron emissive alkaline earth oxide layer (hereinafter referred to as "oxide layer"). Heretofore, in order to strengthen the bonding strength between the oxide layer 3 and the base 1, there has been employed a method for interposing Ni powders between the oxide layer and the base. But according to this method, there often takes place thermal deformation of the cathode during the production procedures of the cathode or during the use of the cathode after installing it, for example in an electron tube, which results in finally causing peeling of the oxide layer 3 from the base 1. The peeling of the oxide layer 3 from the base 1 means a stop of the action as cathode. Thus, various proposals have been made in order to prevent the peeling of the oxide layer.

One of main technical ideas among these proposals is, to say simply, that a main cause of the peeling of the oxide layer is thermal deformation of the base itself and the peeling of the oxide layer can be prevented if the thermal deformation of the base is prevented.

Based on such an idea, U.S. Pat. No. 4,081,713 discloses a directly heated type oxide cathode wherein both the upper and lower surfaces of the base is coated with Ni and the like powders and the oxide layer is formed on the upper surface of the base. Such a structure is based on an idea that diffusion of the Ni powders proceeds on the both surfaces with the evolution of heat from the base and stress applied to the base can be balanced on the both surfaces, which results in minimizing the deformation of the base, preventing the peeling of the oxide layer and further preventing at the same time an undesirable phenomenon of the loss of a white balance shown in the three electron guns for a color cathode-ray tube.

But even if employing such a structure, it was found that the deformation of the base cannot be prevented completely. There is disclosed in Japanese Patent Appln Kokai (Laid-Open) No. 62454/78 a directly heated type oxide cathode wherein a dense layer of Ni and the like is additionally formed between the base and the Ni powders, or the dense layer of Ni and the like is formed on the lower surface of the base in place of the Ni powders in addition to the Ni dense layer between the upper surface of the base and the Ni powders. Such a structure is based on an idea that strain produced in the base can be suppressed by diffusion of Ni of the both surfaces of the base with the progress of evolution of heat from the base, and the dense Ni layer can prevent influence of the oxide layer, particularly influence during the step of thermal decomposition of the carbonates, which results in minimizing the deformation of the base and thus preventing the peeling of the oxide layer.

A common point of the above-mentioned two proposals is to prevent the deformation of the base by forming layers of Ni and the like on the both surfaces of the base taking the diffusion of Ni into consideration. Therefore, as to Co which is chemically analogous to Ni, the behavior of Co is regarded as the same as that of Ni and there is described that the same results as obtained in the case of Ni can be obtained if a part or whole of Ni is replaced by Co.

But the coating of Ni powders or the formation of Ni layers on the both surfaces of the base not only makes the production procedures complicated but also gives disadvantages in that high technique is required for providing an equivalent amount of Ni to the both surfaces, and if Ni is provided ununiformly on the both surfaces, the deformation of the base is rather accelerated. Further, the formation of uneven layer of Ni on the lower surface of the base gives another defect in that minute adjustment of the gap cannot be expected when the cathode is installed in an electron tube and the like.

On the other hand, there have also been made proposals for forming a layer of alloy containing Ni as a major component on only the upper surface of the base, i.e. the surface on which the oxide layer is formed, not on the both surfaces of the base. For example, the structure as shown in FIG. 2 is disclosed in U.S. Pat. No. 4,129,801. According to said U.S. patent, a metal layer 6 made of an alloy containing at least one of W and Mo in an amount of 10% by weight or less, Zr 1.5% by weight or less and the balance at least one of Ni and Co is formed on the base 1, and a bonding layer 7 is formed on the metal layer 6, said bonding layer being made of powders of Ni-Co alloy or a mixture of Ni and Co powders (Co 35–65% by weight and Ni 65–35% by weight), and an oxide layer 3 is formed on the bonding layer. The feature of this structure is to have the bonding layer 7 made of the special Ni-Co alloy and the metal layer 6 may be omitted. Said U.S. patent is based on an idea that the deformation of the base can be prevented by applying the fact that unbalanced diffusion between Ni powders-to-the base and Co powders-to-the base is reversed, said unbalanced diffusion causing the deformation of the base, that is, by offsetting deformations due to the mutual diffusion by simultaneous use of Ni and Co having mutually reversed actions to the thermal deformation of the cathode base. In such a case, the powders of Ni-Co alloy has the same action as that of the powder mixture of Ni and Co. Therefore, it is necessary to bake the Ni powders and Co powders to the same extent. But since uniform coating of the Ni and Co powders is very difficult and baking properties of the Ni powders, Co powders and the base metal are different, the baking procedure is very difficult. Further, since unbalance in diffusion is dependent on the composition of the base, it is necessary to change the mixing ratio of the Ni powders and the Co powders depending on the composition of the base. In addition, according to said U.S. patent, when Ni and Co powders having almost the same particle size or Co powders having a larger particle size than Ni powders are used, the baking of Co is preceded by the baking of Ni and the reaction between Zr and the oxides is not suppressed, so that the deformation of the Ni powders takes place and thus the deformation of the base cannot be prevented. Further, there is a tendency to easily bring about the peeling of the oxide layer and to increase the degree of deformation itself with an increase of the Zr content in the base.

As to alloys for forming the base, there have been known those containing Ni as a major component, one or more high-melting point metals such as W, Mo, etc., in order to increase heat resistance and mechanical strength, and a reducing agent, i.e. a metal or element which functions as an activating agent for the electron emissive oxides, such as Mg, Al, Si, Zr, or the like. The use of Zr as reducing agent is preferable on maintaining activity of the cathode for a long period of time as well as from the viewpoint of cold workability of the base. But when the base is made of an alloy containing Zr as reducing agent, Ni powders or Ni dense layer is coated on the base in order to prevent the peeling of the oxide layer according to the conventional method and the electron emissive oxide layer is formed thereon, there is a tendency that the oxide layer is easily peeled off during the operation of an electron tube in which the resulting cathode is installed. Causes of such a phenomenon have not fully been understood from the conventional viewpoints of diffusion of Ni and Co, diffusion of W, and the like.

SUMMARY OF THE INVENTION

The present inventors have extensively studied the behavior of Zr, affinity of Ni and Zr, affinity of Co and Zr, diffusion of Zr into Ni powder particles, and the like, and accomplished this invention.

This invention provides a directly heated type oxide cathode comprising a base made of an alloy containing Ni as a major component and Zr as a reducing agent, a diffusion prevention layer made of Co or Co-Ni alloy containing Co in an amount of more than 80% by weight formed on the base, a coating of Ni powders formed on the diffusion prevention layer, and an electron emissive alkaline earth oxide layer formed on the coating of Ni powders.

According to this invention, the oxide cathode of this invention is remarkably excellent in prevention of peeling of the oxide layer and prevention of deformation of the base compared with a conventional structure wherein Ni powders or Ni alloy powders are directly baked on the base. The cross-section of the oxide cathode of this invention is as shown in FIG. 3. In FIG. 3, numeral 1 denotes a base, numeral 5 denotes a diffusion prevention layer, numeral 4 denotes Ni powders, and numeral 3 denotes an oxide layer.

BRIEF DESCRIPTION OF THE DRAWINGS

This invention and the prior art is explained referring to the attached drawings, wherein.

DETAILED DESCRIPTION OF THE INVENTION

Figure 1:
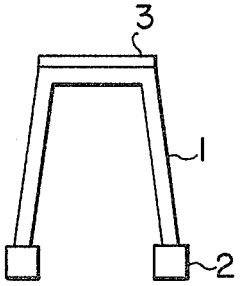
FIG. 1 is a sectional view of a conventional directly heated type oxide cathode.
Figure 2:
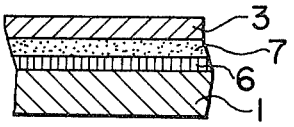
FIG. 2 is a sectional view of the main portion of a known directly heated type oxide cathode.
Figure 3:
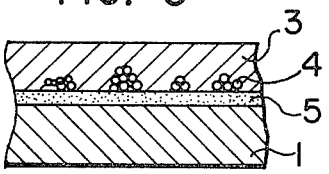
FIG. 3 is a sectional view of the main portion of the directly heated type oxide cathode of this invention.

This invention is based on ingenious application of a difference between affinity of Zr to Ni and affinity of Zr to Co by combining the base made of an alloy containing Ni as a major component and Zr as a reducing agent with the diffusion prevention layer. That is, it was found that the deformation of Ni particles in a cathode of the conventional structure during the operation of the cathode is caused by diffusion of Zr in the base metal into the Ni particles due to great affinity of Zr to Ni and by reaction with the so-called oxides. It was also found that in order to prevent such a deformation, it is preferable to form a layer made of a metal having smaller affinity to Zr than Ni before the coating of Ni particles on the surface of the base so as to prevent the diffusion of Zr into the Ni particles. As the metals satisfying such conditions, various metals such as Cr, Mn, Fe, Co, Cu, Ag, Mo and W were studied and evaluated and as a result, it was found that Co is the most effective. Further, it was also found that in order to make this invention effective, special relations should be maintained among the amount of Zr in the base, the thickness of the diffusion prevention layer and the composition thereof.

As to the amount of Zr in the base, it is necessary to maintain the Zr content in the range of 0.02 to 5% by weight, more preferably 0.05 to 5% by weight. Since the diffusion of Co on the surface of the base prevents the reaction between Zr in the base and the electron emissive oxides (hereinafter referred to as "oxide"), activity becomes insufficient when the amount of Zr is less than 0.02% by weight. On the other hand, when the amount of Zr is more than 5% by weight, there is produced a low-melting point eutectic which produces another problem as the base of directly heated type oxide cathode.

As to the composition of the diffusion prevention layer, there is no problem when the diffusion prevention layer is made of Co alone. When a Co-Ni alloy is used, Co content should be more than 80% by weight, i.e. Ni should be 20% by weight or less. If the Ni content is more than 20% by weight, the effect of prevention of diffusion of Zr into Ni particles is undesirably lost.

As to the thickness of the diffusion prevention layer, it is preferable to use a thickness of 200 Å to 10 μm. When the thickness is less than 200 Å, the effect of prevention of diffusion cannot be obtained, while when the thickness of more than 10 μm, electric resistance of the cathode as a whole is lowered below the permissible limit for practical use and this is not preferable from the viewpoint of practical use. Further, it is preferable to determine the thickness of the layer considering the particle size of Ni powders to be baked on the layer. Practical average particle size of Ni powders used in the production of directly heated type oxide cathodes is 1 to 10 μm and in such a case the thickness of the diffusion prevention layer of 200 Å to 10 μm is preferable. If necessary, the thickness of the diffusion prevention layer may be changed depending on the particle size of Ni powders.

In addition, the thickness of the diffusion prevention layer has a relationship with the amount of Zr. The lower limit of the thickness of the layer necessary for preventing diffusion of Zr is 200 Å at 0.05% by weight of Zr, and 1000 Å at 1.0% by weight of Zr and intermediate values being on a straight line drawn between the above-mentioned two points. When the amount of Zr is more than 1% by weight, the thickness of the layer is constantly 1000 Å. In any cases, experimentally preferable thickness of the layer is 500 Å to 2 μm. Further, in order to increase strength at higher temperatures and to prevent the deformation of the cathode, addition of one or more high-melting point metals such as W, Mo and the like to the base metal is more effective.

The diffusion prevention layer can be formed by using a conventional method such as a vacuum metallizing method, an ion plating method, a plating method, a cladding method, or the like. Further, the diffusion prevention layer can also be formed by coating very fine Co powders having a particle size of about less than 1 μm.

After forming the diffusion prevention layer, Ni powders are coated thereon using a conventional method. As the Ni powders, those having an average particle size of 1 to 10 μm are preferable and those of 2 to 6 μm are more preferable. Coating amount of the Ni powders is preferably 0.1 to 5 mg/cm$^2$, more preferably 0.4 to 3 mg/cm$^2$. The Ni powders are then baked, for example, at 700° to 1100° C. for 5 to 60 minutes in vacuum.

The alloy used for making the base comprises Ni as a major component and Zr as a reducing agent. The alloy may further contain one or more high-melting point metals such as W, Mo, and the like. When W alone is used in the base metal, it is used in the range of 15 to 30% by weight. When Mo alone is used in the base metal, it is used in the range of 10 to 22% by weight. When the content of W is less than 15% by weight or the content of Mo is less than 10% by weight, the strength at high temperatures becomes insufficient and the base is liable to be deformed by stress produced by mutual unbalanced diffusion of the Co or Co-Ni layer bonded and the base (Ni-W(Mo)-Zr). On the other hand, when the content of W is more than 30% by weight or the content of Mo is more than 22% by weight, there is a fear of ununiform deformation of the base by precipitation of the high-melting point metal after repeating temperature rise and cooling of the cathode during the operation and non-operation considering the solid solubility limit with Ni in the base. When W is used together with Mo, it is necessary to use these metals within the range so as not to be precipitated considering the solid solubility limit of the high-melting point metals as a whole with Ni as mentioned above. For example, it is preferable to use Mo in an amount of 10 to 22% by weight and W in an amount of 1 to 8% by weight. Metals other than W and Mo, e.g. Re, etc. can also be used as a component of the base metal.

The addition of such high-melting point metal or metals to the base metal is particularly effective when a Co layer is used as the diffusion prevention layer. This is because since diffusion speed is different between Co and Ni, when the both are stuck, there takes place unbalanced diffusion between the two and deformation of the base is liable to take place. This can be prevented by the addition of the high-melting point metal to the base metal.

The base metal may contain one or more other reducing agents such as Al, Mg, Si and the like in addition to Zr.

The oxide layer can be formed on the baked Ni powder by using a conventional method.

The directly heated type oxide cathode of this invention can be used not only in television display tubes but also in electron tubes widely, for example, camera tubes, etc.

This invention is illustrated by way of the following Examples, in which all percents are by weight unless otherwise specified.

EXAMPLE 1

On a base having a thickness of 40 μm and made of an alloy containing 27.5% of W, 0.4% of Zr and the remainder being Ni, Co was coated by a vacuum evaporation process in 2500 Å thick and Ni powders having an average particle size of 2 to 3 μm were coated thereon in an amount of 1.5 mg/cm$^2$ and heated at 900° C. for 30 minutes in vacuum for baking. Subsequently, carbonates of Ba, Sr, and Ca were coated thereon and heated at 1000° C. for 10 hours in vacuum to give an oxide cathode.

The oxide layer converted from the carbonates was removed from the cathode and the state of Ni powders was examined by using a scanning electron microscope to find out that the form of Ni powders was not changed.

For comparison, when Co was not coated by a vacuum evaporation process in the above mentioned process, deformation of Ni powders took place.

Adhesive strength of the oxide layer to the base was tested. When the Co layer was formed, the adhesive strength was 85% of the value after baking the Ni powders, whereas when no Co layer was formed, it was lowered to 30% of the value after baking the Ni powders.

Adhesive strength was measured as follows. After immersing a cellulose resin (acetyl cellulose) in a solvent (methyl acetate), the resin was placed on powders and dried to measure by using a load cell.

In addition, when a layer of Co-Ni alloy (Co 50%, Ni 50%) was formed in place of the Co layer, deformation of the Ni powders took place and the effect of this invention was not obtained.

EXAMPLE 2

On a base having a thickness of 40 μm and made of an alloy containing 17.5% of Mo, 0.8% of Zr and the remainder being Ni, Co was coated by a vacuum evaporation process in 6000 Å thick and Ni powders having an average particle size of 2 to 3 μm were coated thereon in an amount of 1.5 mg/cm$^2$ and heated at 900° C. for 30 minutes in vacuum for baking. Subsequently, carbonates of Ba, Sr and Ca were coated thereon and heated at 1000° C. for 10 hours in vacuum to give an oxide cathode.

The oxide layer was removed from the cathode and the state of Ni powders was examined by using a scanning electron microscope to find out that the form of Ni powders was not changed.

For comparison, when Co was not coated by a vacuum evaporation process in the above-mentioned process, deformation of Ni powders took place.

Adhesive strength of the oxide layer to the base was tested. When the Co layer was formed, the adhesive strength was more than 90% of the value after baking the Ni powders and almost no decrease was observed, whereas when no Co layer was formed, it was lowered greatly to 20% of the value after baking the Ni powders.

EXAMPLE 3

An oxide cathode was produced in the same manner as described in Example 1 except for using a base having a thickness of 30 μm and made of an alloy containing 4% of W, 15% of Mo, 1.2% of Zr and the remainder being Ni.

No deformation of Ni powders was observed and adhesive strength of the oxide layer to the base was the same as that of Example 1.

EXAMPLE 4

An oxide cathode was produced in the same manner as described in Example 1 except for using a base made of an alloy containing 27.5% of W, 2.2% of Zr and the remainder being Ni.

No deformation of Ni powders was observed and adhesive strength of the oxide layer to the base was the same as that of Example 1.

As mentioned above, according to this invention, since diffusion of Zr which is an activating agent into Ni powder particles is suppressed by the Co layer formed on the base, no deformation of Ni powder particles takes place and thus peeling of the oxide layer hardly takes place. Further, in a conventional technique, when Ni diffuses on the surface at the time of baking of the Ni powders, Zr also diffuses on that portion to form a high density Zr layer on the surface of the base. Such an action often forms an interface layer of $BaZrO_3$ at the initial stage of the operation and gives bad influence on the electron emissive properties. Such bad influence can be prevented by coating the Co layer (the diffusion prevention layer) on the base according to this invention.

What is claimed is:

1. A directly heated type oxide cathode comprising a base made of an alloy containing Ni as a major component and Zr as a reducing agent, a diffusion prevention layer made of Co or Co-Ni alloy containing Co in an amount of more than 80% by weight formed on the base, a coating of Ni powders formed on the diffusion prevention layer, and an electron emissive alkaline earth oxide layer formed on the coating of Ni powders, whereby said diffusion prevention layer can prevent diffusion of Zr into said Ni powders.

2. A cathode according to claim 1, wherein the alloy for making the base contains 0.05 to 5% by weight of Zr.

3. A cathode according to claim 1, wherein the thickness of the diffusion prevention layer is 200 Å to 10 μm.

4. A cathode according to claim 1, wherein the alloy for making the base contains 15 to 30% by weight of W, 0.05 to 5% by weight of Zr and the remainder being Ni.

5. A cathode according to claim 1, wherein the alloy for making the base contains 10 to 22% by weight of Mo, 0.05 to 5% by weight of Zr and the remainder being Ni.

6. A cathode according to claim 1, wherein the alloy for making the base contains 1 to 8% by weight of W, 10 to 22% by weight of Mo, 0.05 to 5% by weight of Zr and the remainder being Ni.

7. A cathode according to claim 1, wherein the alloy for making the base contains 15 to 30% by weight of W, 0.05 to 5% by weight of Zr and the remainder being Ni, with part of the W in the alloy for making the base being replaced by Re.

8. A cathode according to claim 1, wherein the alloy for making the base contains 10 to 22% by weight of Mo, 0.05 to 5% by weight of Zr and the remainder being Ni, with part of the Mo in the alloy for making the base being replaced by Re.

9. A cathode according to claim 1, wherein the alloy for making the base contains 1 to 8% by weight of W, 10 to 22% by weight of Mo, 0.05 to 5% by weight of Zr and the remainder being Ni, with a part of the W and/or Mo in the alloy for making the base being replaced by Re.

10. A cathode according to claim 1, wherein the diffusion prevention layer has a thickness such that diffusion of Zr through said diffusion prevention layer is prevented.

11. A directly heated type oxide cathode comprising a base made of an alloy containing Ni as a major component, W and/or Mo and 0.05 to 5% by weight of Zr, a diffusion prevention layer having a thickness of 200 A to 10 μm and made of Co or Co-Ni alloy containing Co in an amount of more than 80% by weight formed on the base, a coating of Ni powders formed on the diffusion prevention layer, and an electron emissive alkaline earth oxide layer formed on the coating of Ni powders, whereby said diffusion prevention layer can prevent diffusion of Zr into said Ni powders.

12. A cathode according to claim 11, wherein the diffusion prevention layer has a thickness such that diffusion of Zr through said diffusion prevention layer is prevented.

* * * * *